US010801275B2

(12) United States Patent
Gruess et al.

(10) Patent No.: US 10,801,275 B2
(45) Date of Patent: Oct. 13, 2020

(54) ELEVATOR SYSTEM FOR SUPPORTING A TUBULAR MEMBER

(71) Applicant: FORUM US, INC., Houston, TX (US)

(72) Inventors: Arno Gruess, Klein Nordende (DE); Frederik Stoldt, Hamburg (DE)

(73) Assignee: FORUM US, INC., Houston, TX (US)

( * ) Notice: Subject to any disclaimer, the term of this patent is extended or adjusted under 35 U.S.C. 154(b) by 17 days.

(21) Appl. No.: 15/604,778

(22) Filed: May 25, 2017

(65) Prior Publication Data

US 2018/0340379 A1 Nov. 29, 2018

(51) Int. Cl.

| | |
|---|---|
| ***E21B 19/04*** | (2006.01) |
| ***E21B 19/07*** | (2006.01) |
| ***E21B 41/00*** | (2006.01) |

(52) U.S. Cl.

CPC ..... *E21B 19/04* (2013.01); *E21B 19/07* (2013.01); *E21B 41/00* (2013.01)

(58) Field of Classification Search

CPC ..... E21B 19/06; E21B 19/07; E21B 19/00; F16L 1/207; Y10S 414/123; G05G 5/00

See application file for complete search history.

(56) References Cited

U.S. PATENT DOCUMENTS

| | | | | |
|---|---|---|---|---|
| 2,491,711 | A * | 12/1949 | Calhoun | E21B 19/10 188/67 |
| 4,269,554 | A * | 5/1981 | Jackson | E21B 19/14 294/102.2 |
| 4,511,168 | A | 4/1985 | Haynes | |
| 4,604,724 | A | 8/1986 | Shaginian et al. | |
| 5,791,410 | A * | 8/1998 | Castille | E21B 19/10 166/77.1 |
| 7,055,333 | B2 | 6/2006 | Leitch et al. | |
| 7,182,133 | B2 | 2/2007 | Webre et al. | |
| 8,141,923 | B2 * | 3/2012 | Bouligny | E21B 19/07 294/102.2 |
| 8,733,454 | B2 | 5/2014 | Bouligny et al. | |
| 2007/0131416 | A1 * | 6/2007 | Odell, II | E21B 19/06 166/250.1 |
| 2009/0252589 | A1 * | 10/2009 | Sonneveld | E21B 19/10 414/800 |

(Continued)

FOREIGN PATENT DOCUMENTS

| | | | |
|---|---|---|---|
| DE | 102004061381 | A1 | 7/2006 |
| EP | 1916344 | A2 | 4/2008 |
| WO | 1994007068 | A1 | 3/1994 |

OTHER PUBLICATIONS

"Door" Definition by Merriam-Webster. Accessible from https://www.merriam-webster.com/dictionary/door (Year: 2019).*

*Primary Examiner* — Blake E Michener
*Assistant Examiner* — Theodore N Yao
(74) *Attorney, Agent, or Firm* — Patterson & Sheridan, L.L.P.

(57) ABSTRACT

An elevator system that supports a tubular member includes an elevator movable between a first elevator position and a second elevator position. A mechanical signal mechanism is coupled to the elevator. A valve is coupled to the mechanical signal mechanism. The mechanical signal mechanism is configured to transmit a mechanical signal by a mechanical control cable to move the valve into a valve position to send a valve signal that the elevator is in the second elevator position.

19 Claims, 7 Drawing Sheets

(56) References Cited

U.S. PATENT DOCUMENTS

| | | | | |
|---|---|---|---|---|
| 2009/0272542 | A1* | 11/2009 | Begnaud | E21B 19/07 166/380 |
| 2013/0104367 | A1 | 5/2013 | Childress, II et al. | |
| 2015/0021946 | A1 | 1/2015 | Vierke et al. | |
| 2016/0356104 | A1 | 12/2016 | Vierke et al. | |

* cited by examiner

ELEVATOR SYSTEM FOR SUPPORTING A TUBULAR MEMBER

BACKGROUND

Field

Embodiments described herein generally relate to elevator systems for supporting tubular members in the field of oil and gas production. The elevator systems have safety apparatuses and methods for signaling the position of the elevator.

Description of the Related Art

In the oil and gas industry, it is the usual practice to hoist various types of tubular members, such as drill strings, production tubing, and other pipes, on rigs with various elevators of different capacities. The internal diameters and configurations of the elevators are designed for precise inter-fitting relation with tool joints of the tubular members to be handled. Some types of elevators may have clamp elements (i.e., slips) that move from a first position to a second position where the clamp elements engage and support a tubular element. For safety reasons, it is advantageous to detect when the elevator is in these different positions so that an operator will know if the elevator is securely supporting a tubular member or not.

Therefore there is a need for new and/or improved elevator systems that detect the position of an elevator.

SUMMARY

Embodiments of the disclosure describe an apparatus and method for an elevator system that supports a tubular member used for production of oil and gas. In one embodiment, the elevator system includes an elevator movable between a first elevator position and a second elevator position. A mechanical signal mechanism is coupled to the elevator. A valve is coupled to the mechanical signal mechanism. The mechanical signal mechanism is configured to transmit a mechanical signal by a mechanical control cable to move the valve into a valve position to send a valve signal that the elevator is in the second elevator position.

In another embodiment, the elevator system includes an elevator movable between a first elevator position and a second elevator position. A sensor mechanism is coupled to the elevator and configured to make a sensor mechanism movement in response to the elevator moving from the first elevator position to the second elevator position. A mechanical control cable has a first cable end and a second cable end, and the first cable end is coupled to the sensor mechanism. A trigger mechanism is coupled to the second end of the mechanical control cable. The mechanical control cable transmits the movement of the sensor mechanism to the trigger mechanism so that the trigger mechanism has a trigger movement. A valve is coupled to the trigger mechanism. The trigger movement of the trigger mechanism is transmitted to the valve to move the valve into a position to send a valve signal that the elevator is in the second elevator position.

In another embodiment, a method includes moving an elevator between a first elevator position to a second elevator position. The method further including transmitting a mechanical signal by a mechanical control cable coupled to a valve to move the valve into a valve position to send a valve signal that the elevator is in the second elevator position.

BRIEF DESCRIPTION OF THE DRAWINGS

So that the manner in which the above recited features of the disclosure can be understood in detail, a more particular description of the disclosure, briefly summarized above, may be had by reference to implementations, some of which are illustrated in the appended drawings. It is to be noted, however, that the appended drawings illustrate only selected implementations of this disclosure and are therefore not to be considered limiting of its scope, for the disclosure may admit to other equally effective implementations.

To facilitate understanding, identical reference numerals have been used, wherever possible, to designate identical elements that are common to the Figures. Additionally, elements of one implementation may be advantageously adapted for utilization in other implementations described herein.

DETAILED DESCRIPTION

Embodiments herein generally provide an elevator system incorporating a mechanical signal mechanism used on a rig to produce oil and gas. The elevator system includes an elevator for supporting and moving various types of tubular members, such as drill strings, production tubing and other pipes, on rigs. A mechanical signal mechanism is coupled to the elevator and used to trigger a safety alert that the elevator has changed positions.

The mechanical signal mechanism has a sensor mechanism that is located on the elevator and moves in response to the elevator changing positions. The mechanical signal mechanism is configured to transmit the movement of the sensor mechanism to a trigger mechanism using a mechanical control cable. The trigger mechanism of the mechanical signal mechanism is used to move a hydraulic valve into a selected valve position to send a hydraulic signal indicating the position of the elevator.

The sensor mechanism may be positioned in a location on the elevator that does not have the hydraulic space for the hydraulic valve and an attached control line including a hydraulic supply line and return line needed for the hydraulic valve. For example, the sensor mechanism may be positioned adjacent to a clamp element of the elevator where there is limited space for the hydraulic valve and the control line. The hydraulic valve is separately located from the sensor mechanism on the elevator and is coupled to the sensor mechanism by the mechanical control cable of the mechanical signal mechanism.

The mechanical control cable enables the hydraulic valve to be separately located from the sensor mechanism, including locating the hydraulic valve on the elevator separately from sensor mechanism or locating the hydraulic valve remotely from the elevator at a location on the rig. One benefit of the mechanical signal mechanism is that space requirements for the hydraulic valve and control line at the location of the sensor mechanism is minimized or eliminated by separately locating the hydraulic valve through use of the mechanical signal mechanism.

Figure 1:
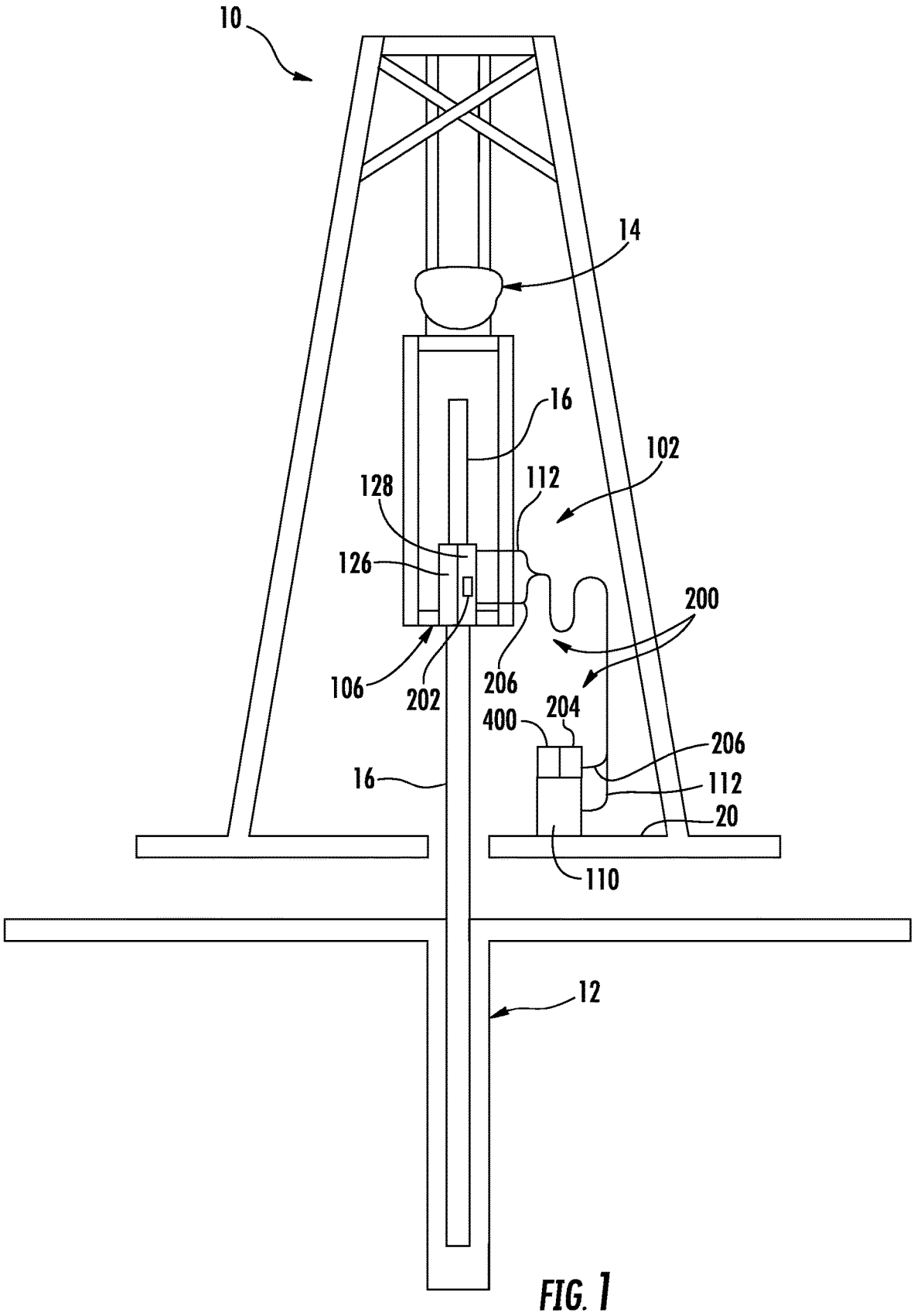
FIG. 1 depicts a schematic view of an elevator system used on a rig according to one embodiment.

FIG. 1 is a schematic view of a rig 10 incorporating an elevator system 102 according to one embodiment. FIG. 1 depicts the rig 10 disposed over a well bore 12. The elevator system 102 includes an elevator 106, a control station 110, and a control line 112 extending between elevator 106 and control station 110. The elevator 106 is supported by a lifting system 14 schematically shown on the rig 10 for raising and lowering the elevator 106. The elevator 106 and the elevator doors 126, 128 of the elevator 106 are shown in a closed position to support the weight of a tubular member 16. The control station 110 controls the opening and closing of the elevator 106 through the control line 112 using hydraulic fluid, pressurized gas or electricity.

The elevator system 102 further comprises a mechanical signal mechanism 200 that includes a sensor mechanism 202, a trigger mechanism 204, and a mechanical control cable 206 that couples the sensor mechanism 202 to the trigger mechanism 204. The mechanical signal mechanism 200, as discussed in more detail with respect to FIGS. 2-7, is configured to transmit a mechanical signal between sensor mechanism 202 and trigger mechanism 204 by the mechanical control cable 206 so that the trigger mechanism 204 has a trigger movement.

A valve in the form of a hydraulic valve 400 is coupled to the trigger mechanism 204 such that the trigger movement of the trigger mechanism 204 is transmitted to the hydraulic valve 400 to move the hydraulic valve 400 into a position to send a valve signal in the form of a hydraulic signal indicating a position of the elevator 106 to the control station 110. In other embodiments, the valve may be in the form of an electric valve or pneumatic valve that is coupled to the trigger mechanism 204 such that the trigger movement of the trigger mechanism 204 is transmitted to the electric valve or pneumatic valve to move the valve into a position to send either an electric signal or a pressurized gas signal, respectively, indicating a position of the elevator 106 to the control station 110. The sensor mechanism 202 shown in FIG. 1 is located on the elevator door 128 of the elevator 106. In other embodiments, the sensor mechanism 202 may be located at other locations on the elevator 106.

In one embodiment, the control line 112 may include the mechanical control cable 206 for use in detecting the position of the elevator 106. The mechanical control cable 206 for some embodiments would extend from the elevator 106 to a trigger mechanism 204 disposed remotely from the elevator 106, as shown in the embodiment of FIG. 1. For example, the trigger mechanism 204 is coupled to the control station 110. The trigger mechanism 204 is also coupled to a hydraulic valve 400 coupled to the control station 110. The control station 110, the trigger mechanism 204, and the hydraulic valve 400 in some embodiments may be located on a rig floor 20, and are discussed in more detail with respect to FIGS. 2-7. In other embodiments of the elevator system 102, the trigger mechanism 204 and hydraulic valve 400 would be located on the elevator 106, as shown in FIG. 2.

Figure 2:
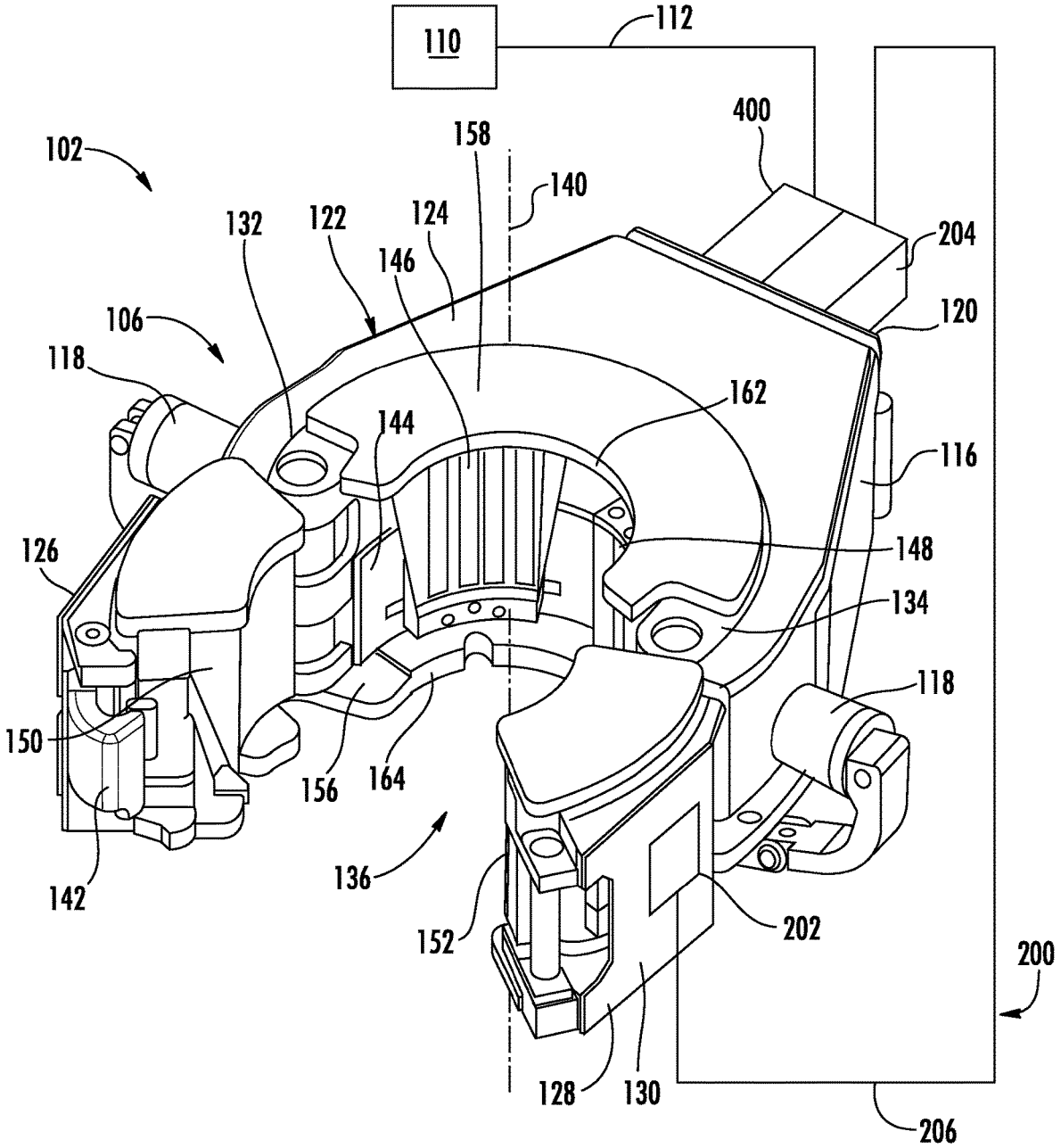
FIG. 2 depicts a schematic perspective view of an elevator system with the elevator in an open position according to one embodiment.

Referring to FIG. 2, an elevator system 102 is shown with an elevator 106 in an open position. The elevator 106 has two outer ear-like retainer elements 118 on opposite sides in order to attach the elevator 106 mechanically to the lifting system 14 of the rig 10 shown in FIG. 1. The elevator 106 has carrying structure 122 including an elevator body 124 and elevator doors 126, 128 that are pivotably connected to the elevator body 124 on opposite sides by hinges 132, 134. The elevator doors 126, 128 each have a door outer surface 130. The elevator body 124 further includes an elevator body outer surface 116. The elevator body outer surface 116 includes an elevator back surface 120.

The carrying structure 122 extends annularly around a central opening 136 along an axis 140. The elevator doors 126, 128 can be moved relative to the elevator body 124 between the closed positioned (FIG. 1) and the opened position (FIG. 2). In the closed position, the elevator doors 126, 128 are locked by a latch and locking device 142 that prevents an unintentional opening of the doors. In the open position, the central opening 136 is opened circumferentially and the tubular member 16 can be inserted in the central opening 136 radially to the axis 140 of the central opening 136. The movement of the elevator doors 126, 128 and of the latch and locking device 142 is done in some embodiments hydraulically.

In the central opening 136 on inner circumferential surface 144 of the carrying structure 122, a plurality of clamp elements 146, 148, 150, 152 are arranged movably relative to the carrying structure 122 in the central opening 136. The clamp elements 146, 148, 150, 152 are evenly distributed in a circumferential direction. The clamp elements 146, 148, 150, 152 are disposed adjacent the central opening 136. Clamp elements 146, 148 are guided on the carrying structure 122 and clamp elements 150, 152 are guided on the elevator doors 126, 128. However, it should be noted that fewer or more clamp elements 146, 148, 150, 152 can be provided.

Figure 3:
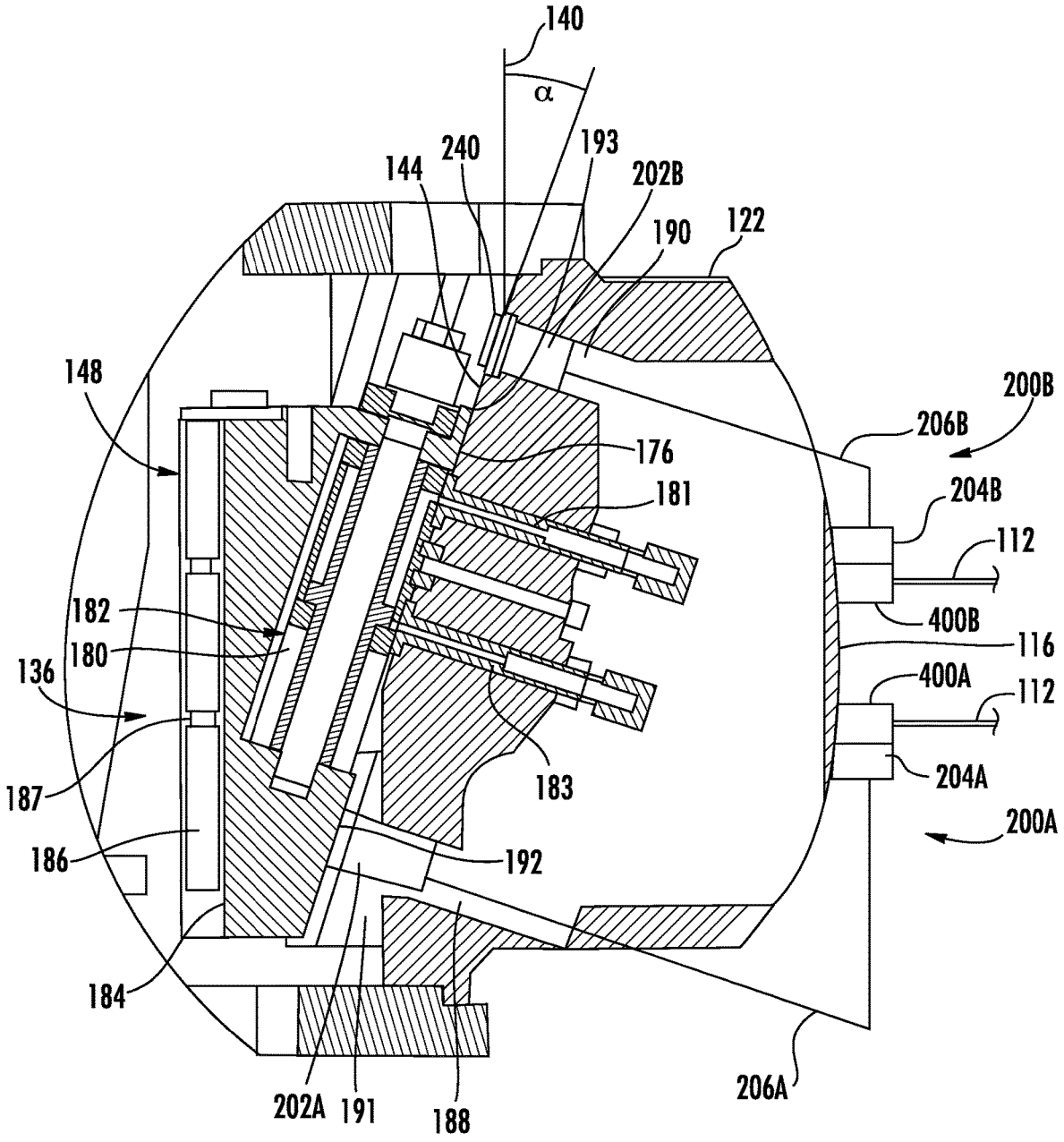
FIG. 3 depicts a schematic cross-sectional view of a clamp element of an elevator coupled to an elevator system according to one embodiment.

The clamp elements 146, 148, 150, 152 may also be referred to as slips. The clamp elements 146, 148, 150, 152 are disposed adjacent the central opening 136 such that the clamp elements 146, 148, 150, 152 can be moved between a lower position and an upper position. In the upper position, the clamp elements 146, 148, 150, 152 are moved radially outwards to introduce or remove the tubular member 16. In the lower position, the clamp elements 146, 148, 150, 152 are moved radially inwards in order to engage or grab and hold the tubular member 16 to support the weight of the tubular member 16 for a following lowering or lifting operation. The lowering and lifting of the clamp elements 146, 148, 150, 152 between the upper position and the lower position is done by a cylinder/piston assembly 182, as shown in FIG. 3.

To protect the clamp elements 146, 148, 150, 152 against unintended contact with the tubular member 16 to be handled, guideplates 156, 158 are provided on the lower side and the upper side of the carrying structure 122. The guideplates 156, 158 have concave inner surfaces 162, 164 and extend radially over the clamp elements 146, 148, 150, 152 in their upper position. In the closed position of the carrying structure 122, the concave inner surfaces 162, 164 form an upper inner circumferential guide surface and a lower inner circumferential guide surface. The upper and the lower circumferential guide surfaces help center the tubular element 16 to be handled in the central opening 136 before they are grabbed by the clamp elements 146, 148, 150, 152.

As shown in FIG. 2, a mechanical signal mechanism 200 is coupled to the elevator 106 and includes a sensor mechanism 202, a trigger mechanism 204, and a mechanical control cable 206 that couples the sensor mechanism 202 to the trigger mechanism 204. The mechanical signal mechanism 200, as discussed in more detail with respect to FIGS. 3-7, is configured to transmit a mechanical signal between the sensor mechanism 202 and the trigger mechanism 204 by the mechanical control cable 206.

In the embodiment shown in FIG. 2, the sensor mechanism 202 is located on a door outer surface 130 of elevator door 128. In other embodiments, the sensor mechanism 202 may be located on the elevator body 124. The sensor mechanism 202 detects a position of the elevator 106, as discussed in more detail with respect to the embodiment shown in FIG. 3. The sensor mechanism 202 is coupled to the trigger mechanism 204 by the mechanical control cable 206.

In the embodiment shown in FIG. 2, the trigger mechanism 204 and the hydraulic valve 400 are coupled together and both are located on the elevator back surface 120 of the elevator body 124. The trigger mechanism 204 and the hydraulic valve 400 may be located in different locations on the elevator body 124 in other embodiments. The mechanical control cable 206 extends from the elevator door 128 and sensor mechanism 202 along the outside of the elevator body 124 to the trigger mechanism 204. The mechanical control cable 206 has sufficient slack between the sensor mechanism 202 and the trigger mechanism 204 when the elevator door 128 is moved between the opened position and closed position. The hydraulic valve 400 is hydraulically coupled to the control station 110 with control line 112 to send a hydraulic signal indicative of the position of the elevator 106 to the control station 110.

Moving the trigger mechanism 204 and the hydraulic valve 400 away from the sensor mechanism 202 provides the benefit of freeing up space on the door outer surface 130 of the elevator door 128. In addition, specific locations on the elevator body 124 such as the elevator back surface 120 may provide a more protected location for the trigger mechanism 204 and hydraulic valve 400 of the embodiment shown in FIG. 2. For example, the elevator doors 126, 128 may use hydraulic apparatuses to hydraulically open and close the elevator doors 126, 128. These hydraulic apparatuses limit the spacing on the elevator doors 126, 128 available for hydraulic valve 400 and the control line 112 needed to provide hydraulics to the hydraulic valve 400.

Referring to FIG. 3, a schematic cross-sectional view of a clamp element 148 is shown. In particular, FIG. 3 shows a cross-sectional view of the clamp element 148 of the elevator 106 coupled to the elevator system 102 according to one embodiment shown in FIG. 2. However, it is mentioned that the following description is not limited to the clamp element 148, but represents all clamp elements 146, 148, 150, 152. As can be seen in FIG. 3, the inner circumferential surface 144 of the carrying structure 122 bounding that central opening 136 tapers conically at a cone angle relative to the axis 140. As can be seen in FIG. 3, the inner circumferential surface 144 of the carrying structure 122 bounding the central opening 136 tapers conically at a cone angle $\alpha$ relative to the axis 140.

The clamp element 148 has a wedge-like cross section and an inclined surface 176 on a radially outer side thereof, the inclined surface 176 is inclined at the cone angle $\alpha$ relative to the axis 140 and is configured and arranged to slide along the inner circumferential surface 144. The recess 180 for receiving the cylinder-piston-arrangements 182 is provided in the inclined surface 176. The cylinder-piston-arrangements 182 are used to raise and lower the clamp element 148. In the embodiment shown in FIG. 3, the clamp element 148 is raised and lowered between a first position and a second position using hydraulic power from fluid conduits 181, 183. The raising and lowering of the clamp elements 146, 148, 150, 152 may be performed using conventional apparatuses and methods.

On a radially inner side, the clamp element 148 has a clamp surface 184 being parallel to the axis 140. To enhance the contact with a tubular member 16 to be handled, a plurality of wedges 186 are provided. The wedges 186 are supported on carriers 187 that are releasably secured to the clamp surface 184.

To detect the position of the clamp element 148, the mechanical signal mechanism 200 for the embodiment shown in FIG. 3 includes a first mechanical signal mechanism 200A for detecting when the clamp element 148 is in the second position and a second mechanical signal mechanism 200B for detecting when the clamp element 148 is in the first position. The first mechanical signal mechanism 200A includes a first sensor mechanism 202A attached to a first mechanical control cable 206A. The second mechanical signal mechanism 200B includes a second sensor mechanism 202B attached to a second mechanical control cable 206B.

The sensor mechanisms 202A, 202B are located in a lower bore 188 and in an upper bore 190 of the carrying structure 122. Mechanical control cable 206A extends from the sensor mechanism 202A through the lower bore 188 and to a first trigger mechanism 204A. Mechanical control cable 206B extends from the sensor mechanism 202B through the upper bore 190 and to a second trigger mechanism 204B. The trigger mechanism 204A is attached to a first hydraulic valve 400A, and the trigger mechanism 204B is attached to a second hydraulic valve 400B. In the embodiment shown in FIG. 3, the trigger mechanisms 204A, 204B and hydraulic valves 400A, 400B are disposed on the elevator body outer surface 116 of elevator body 124. Control line 112 is coupled to hydraulic valves 400A, 400B and extends to control station 110, shown in FIGS. 1-2.

An adapter element 191 can be positioned in the area of the first sensor mechanism 202A between the clamp element 148 and the carrying structure 122 having a wedge-like cross section. The inclined surface 176 of clamp element 148 is formed partially by the adapter element 191 that has a wedge-like shape. When the adapter element 191 is used, the lower bore 188 extends through the adapter element 191 and the first sensor mechanism 202A is positioned at least partially in the adapter element 191.

The sensor mechanisms 202A, 202B extend out of the lower and upper bores 188, 190 in the central opening 136 and are activated by actuation surfaces 192, 193 of the clamp element 148. The actuation surfaces 192, 193 can have inclined surfaces areas relative to the inclined surface 176 of the clamp element 148 which are positioned on opposite ends of the clamp element 148. As can be seen in FIG. 3, when the clamp element 148 is lowered, the lower actuation surface 192 is overlapping the lower bore 188, thus the first sensor mechanism 202A is activated.

In response to the activation of the first sensor mechanism 202A, the first mechanical signal mechanism 200A transmits a first mechanical signal by the first mechanical control cable 206A to move the first hydraulic valve 400A into a valve position to send a hydraulic signal that the elevator 106 is in the second elevator position. When the clamp element 148 is lifted, the upper actuation surface 193 is contacting the second sensor mechanism 202B, thus the second sensor mechanism 202B is activated. In response to the activation of the second sensor mechanism 202B, the second mechanical signal mechanism 200B transmits a second mechanical signal by the second mechanical control cable 206B to move the second hydraulic valve 400B into a valve position to send a hydraulic signal that the elevator 106 is in the first elevator position.

Figure 4:
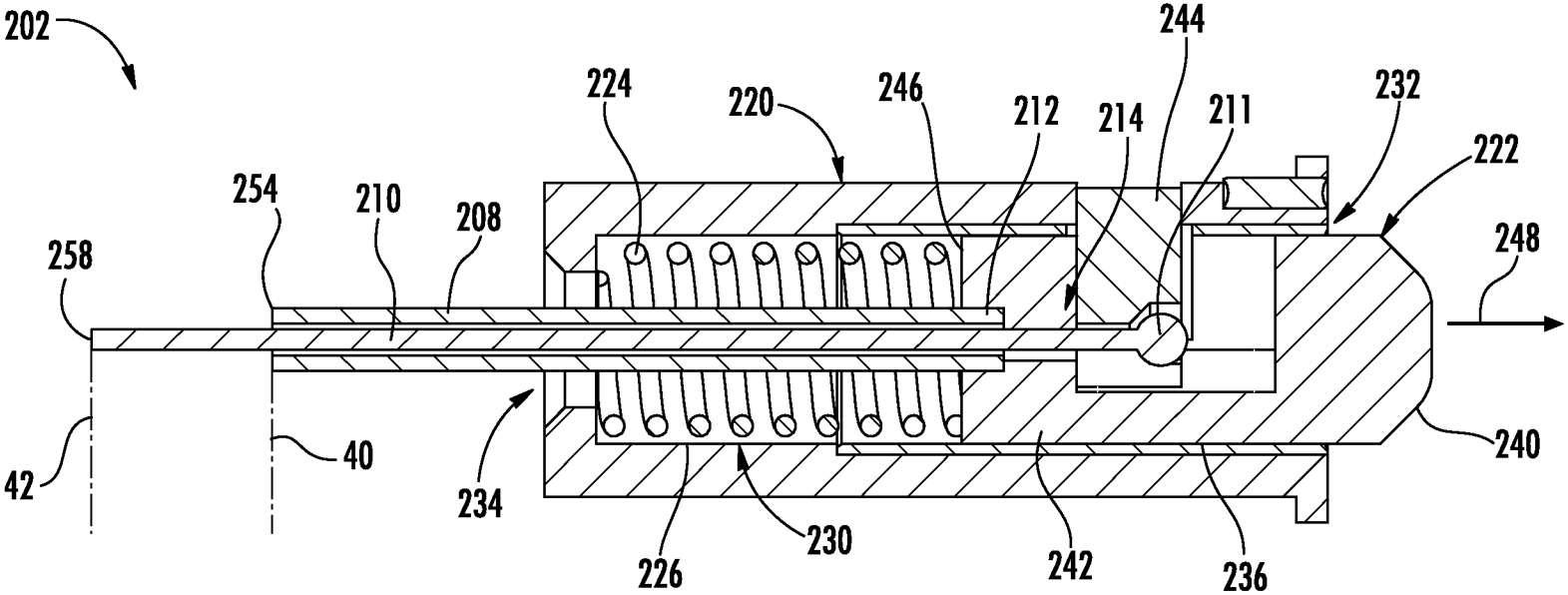
FIG. 4 depicts a schematic cross-sectional view of a mechanical control cable and sensor mechanism in a first position according to one embodiment.

FIG. 4 shows a schematic cross-section of embodiments of the sensor mechanism 202 and the mechanical control cable 206 in a first position, such as a non-activated position. The sensor mechanism 202 and the mechanical control cable 206 shown in FIG. 4 are also representative embodiments of the sensor mechanisms 202A, 202B and mechanical control cable 206A, 206B, shown in FIGS. 1-3. The mechanical control cable may be referred to as a Bowden cable.

A first cable end 214 is disposed in the sensor mechanism 202. The mechanical control cable 206 includes a cable housing 208 and an inner wire 210 extending through the cable housing 208. The inner wire 210 includes a first inner wire end 211 that is used to secure the inner wire 210 to the sensor mechanism 202. The first inner wire end 211 may function as an anchor and have a round shape. The cable housing 208 includes a first cable housing end 212 that is coupled to the sensor mechanism 202. In the embodiment shown in FIG. 4, the first cable end 214 includes the section of the mechanical control cable 206 having the first inner wire end 211 and the first cable housing end 212.

Sensor mechanism 202 includes a sensor housing 220, a sensor element 222, and a sensor biasing mechanism 224. The sensor housing 220 is generally cylindrical in shape and has a sensor housing interior wall 226 that defines a sensor housing interior bore 230. The sensor housing interior bore 230 extends from a first sensor housing opening 232 to a second sensor housing opening 234. Disposed in the sensor housing interior bore 230 is a bore sleeve 236 that is secured to the sensor housing interior wall 226 and extends from the first sensor housing opening 232 to about midway through the sensor housing interior bore 230. The sensor element 222 is sized to fit slidably within a bore sleeve 236 and is movable back and forth within the bore sleeve 236.

The sensor element 222 includes a sensor activation member 240 that extends partially outside the first housing open when in a first position, such as a non-activated position. The sensor activation member 240 is coupled to a housing fastener member 242. The housing fastener member 242 has a bore sized for the inner wire 210 to pass through and the first cable housing end 212 is secured to the housing fastener member 242. The first cable housing end 212 may be secured to the housing fastener member 242 by friction, adhesives or other conventional methods.

Attached to the sensor housing 220 is a wire fastener member 244 used to secure the first inner wire end 211 in the sensor mechanism 202. The wire fastener member 244 extends into the sensor housing interior bore 230 of the sensor housing 220 through bore sleeve 236. The wire fastener member 244 has an opening sized for the first inner wire end 211 and fixes the first inner wire end 211 in a fixed position such that the inner wire 210 remains in a fixed position with respect to the sensor mechanism 202. The housing fastener member 242 further includes an engagement surface 246 disposed in the sensor housing interior bore 230 of the sensor housing 220 that engages with the sensor biasing mechanism 224.

The sensor biasing mechanism 224 is disposed in the sensor housing interior bore 230 towards the second sensor housing opening 234. The sensor biasing mechanism 224 shown in FIG. 4 is a coiled spring. The sensor biasing mechanism 224 may be other types of springs or biasing mechanisms. In the embodiment shown in FIG. 4, the sensor biasing mechanism 224 biases the sensor mechanism 202 in a first position, such as a non-activated position. More specifically, the sensor biasing mechanism 224 is a spring that presses against the engagement surface 246 of the housing fastener member 242 to urge the sensor element 222 to move outwardly away from second sensor housing opening 234 such that the sensor activation member 240 at least partially extends from the first sensor housing opening 232. Biasing arrow 248 shows the direction of bias for the sensor element 222.

As shown in FIG. 4, a section of the cable housing 208 has been removed between vertical line 40 and vertical line 42 to illustrate the movement of the mechanical control cable 206. In the embodiment shown in FIG. 4, the cable housing 208 moves while the inner wire 210 is stationary and functions as a support and guide to the cable housing 208. The section of the inner wire 210 between vertical line 40 and vertical line 42 remains fixed and this section remains stationary when the sensor mechanism 202 moves from the first position shown in FIG. 4 to a second position, such as an activated position shown in FIG. 5.

In an alternative embodiment of the mechanical control cable 206, the cable housing 208 has a fixed position and the inner wire 210 moves relative to the cable housing 208. In the alternative embodiment of the mechanical control cable 206, the inner wire 210 moves in response to the mechanical movements of the sensor mechanism 202 due to the change of position of the elevator 106.

Figure 5:
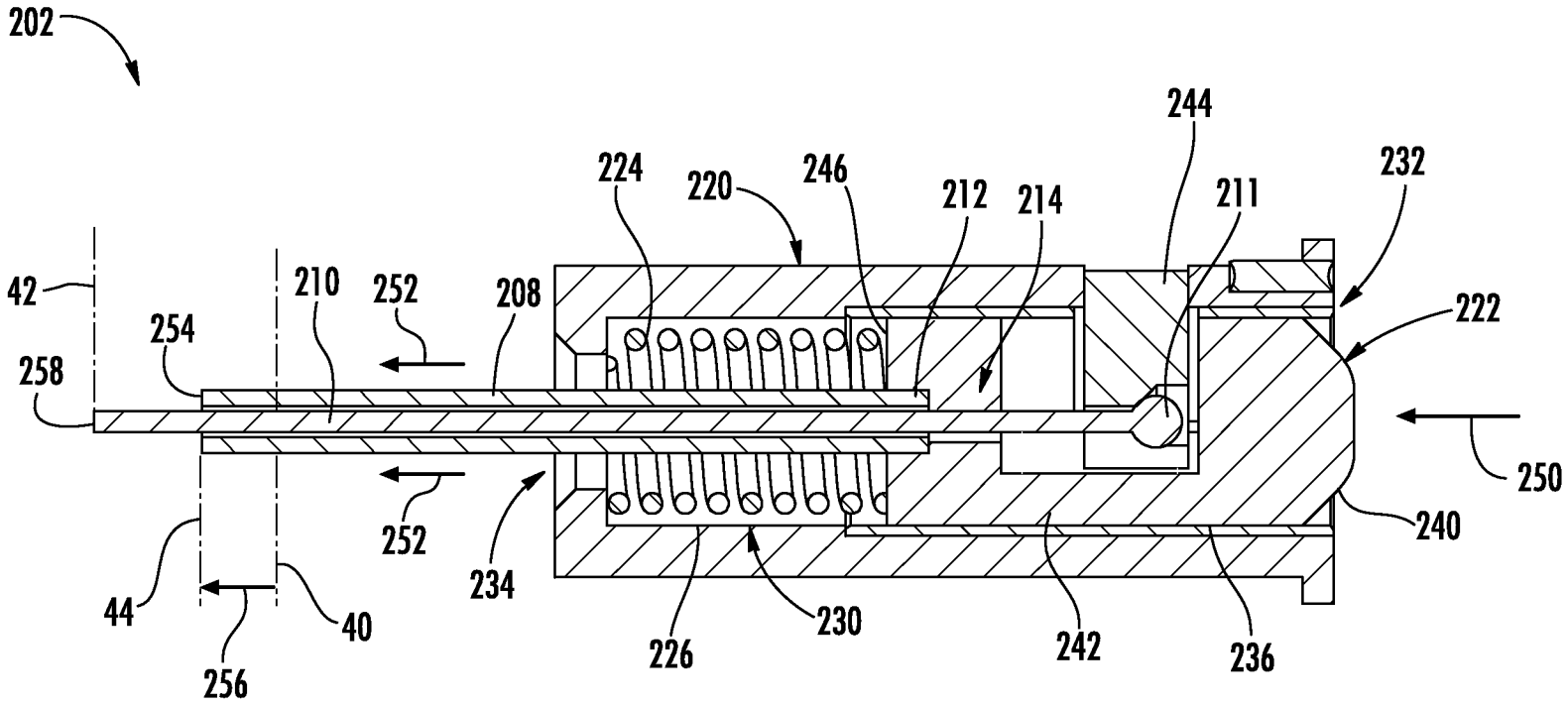
FIG. 5 depicts a schematic cross-sectional view of a mechanical control cable and sensor mechanism in a second position according to one embodiment.

FIG. 5 shows a schematic cross-sectional view of the mechanical control cable 206 and the sensor mechanism 202 in a second position, such as an activated positon, according to one embodiment. The sensor mechanism 202 moves from the first position, shown in FIG. 4, to the second position, shown in FIG. 5, when a mechanical force presses against the sensor element 222 to move the sensor element 222 in the direction of the activation arrow 250. As shown and described for the embodiment of FIG. 3, the movement of the clamp element 148 from the first position to the second position results in a mechanical force that moves the sensor element 222 in the direction of the activation arrow 250 to produce a sensor mechanism movement that places the sensor mechanism 202 in the second position. The sensor mechanism 202 is coupled to the elevator 106 and is configured to make the sensor mechanism 202 movement in response to the elevator 106 moving from the first elevator position to the second elevator position.

The sensor mechanism 202 may be used to detect when the elevator 106 moves from a first position where the elevator doors 126, 128 are open, to a second position where the elevator doors 126, 128 are closed. Likewise, the sensor mechanism 202 may be used to detect when the elevator 106 moves from a second position where the elevator doors 126, 128 are closed to a second position where the elevator doors 126, 128 are open. For example, the sensor mechanism 202 may be positioned on the elevator 106 such that the sensor element 222 is moved to place the sensor mechanism 202 in the second position when the elevator doors 126, 128 are completely closed and locked.

Referring to FIG. 5, moving the sensor element 222 in the direction of activation arrow 250 moves the housing fastener member 242 within the sensor housing interior bore 230 of the sensor housing 220. The sensor element 222, including the housing fastener member 242, moves in the direction of activation arrow 250 by overcoming the biasing force of the sensor biasing mechanism 224 that biases the sensor element 222 in an opposite direction of activation arrow 250. The housing fastener member 242 of the sensor element 222 is attached to the cable housing 208 such that the cable housing 208 moves in the direction shown by cable housing arrows 252. The cable housing 208 of the mechanical control cable 206 transmits a mechanical signal by the cable housing 208 moving in the direction of cable housing arrows 252 in response to the movement of sensor element 222.

Referring to FIGS. 4-5, a section of the cable housing 208 that extends from the sensor mechanism 202 has been removed to illustrate the movement of the mechanical control cable 206 in response to movement of the sensor mechanism 202. In the non-activated position of the sensor mechanism 202 shown in FIG. 4, the end section 254 of cable housing 208 ends at vertical line 40. The end section 254 of cable housing 208 is shown in FIG. 5 to move to a vertical line 44 when sensor mechanism 202 is in the activated position. The movement of the end section 254 of the cable housing 208 in response to the change of position of the sensor mechanism 202 is shown by movement arrow 256. The inner wire 210 remains stationary when the sensor mechanism 202 moves between the first position and the second position as shown by the first wire section end 258 that remains at vertical line 42 in FIGS. 4-5.

Figure 6:
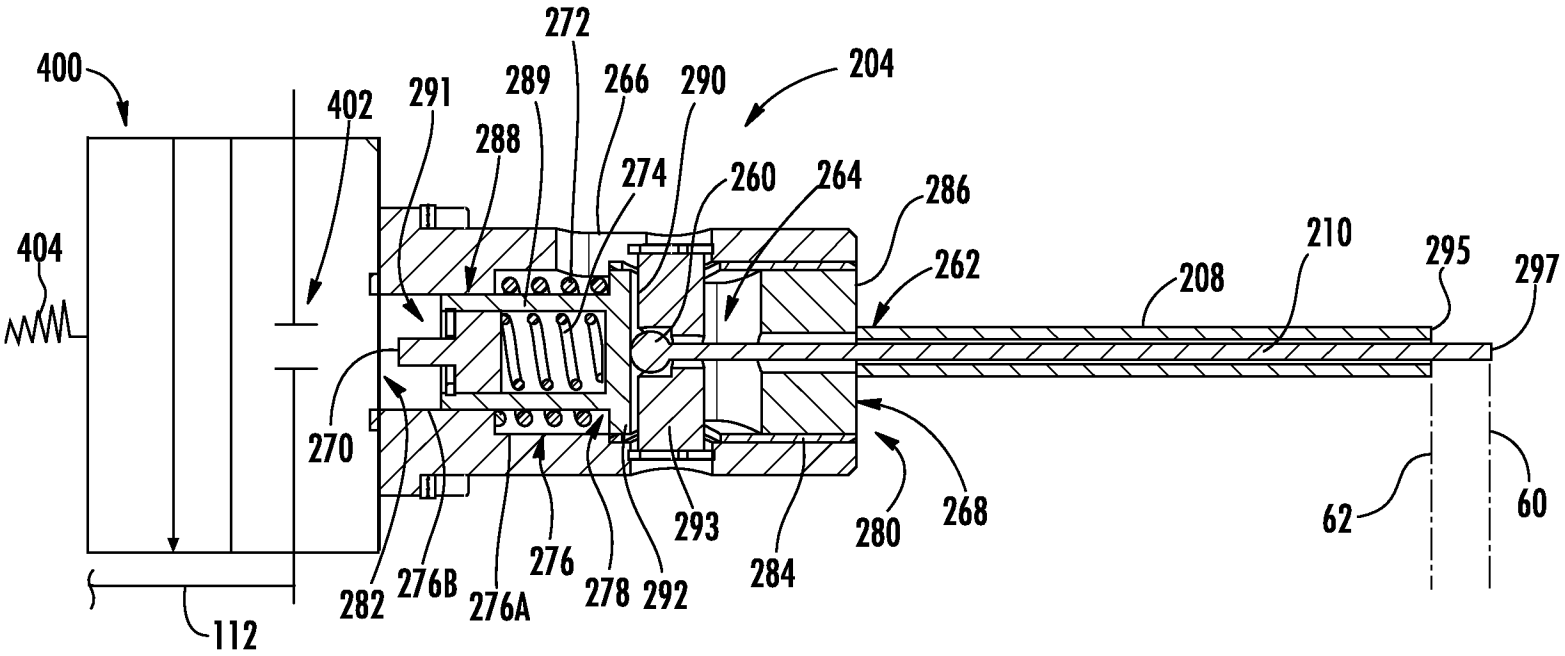
FIG. 6 depicts a schematic cross-sectional view of a mechanical control cable, trigger mechanism, and hydraulic valve in a first position according to one embodiment.

FIG. 6 shows a schematic cross-section of embodiments of the mechanical control cable 206 and the trigger mechanism 204 in the first position, such as a non-activated position. FIG. 4 and FIG. 6 together illustrate the sensor mechanism 202 and the trigger mechanism 204 of the mechanical signal mechanism 200 in the first position, such as a non-activated position. The mechanical control cable 206 coupled to the sensor mechanism 202 in FIG. 4 extends and continues to the trigger mechanism 204 shown in FIG. 6 to illustrate the first position, such as the non-activated position, for the mechanical signal mechanism 200.

The trigger mechanism 204 and the mechanical control cable 206 shown in FIG. 6 are also representative embodiments of the trigger mechanism 204A, 204B and mechanical control cable 206A, 206B, shown in FIGS. 1-3. The inner wire 210 includes a second inner wire end 260 that is used to secure the inner wire 210 to the trigger mechanism 204. The second inner wire end 260 may function as an anchor and have a round shape. The cable housing 208 includes a second cable housing end 262 that is coupled to the trigger mechanism 204. In the embodiment shown in FIG. 6, the second cable end 264 includes the section of the mechanical control cable 206 having the second inner wire end 260 and the second cable housing end 262.

The trigger mechanism 204 includes an outer trigger housing 266, a trigger element 268, an activation trigger 270, a first biasing mechanism 272, and a second biasing mechanism 274. The outer trigger housing 266 is generally cylindrical in shape and has an interior wall 276 that includes a first wall section 276A and a second wall section 276B. The interior wall 276 defines an interior bore 278 that extends from a first trigger housing opening 280 to a second trigger housing opening 282. Disposed in the interior bore 278 is a trigger bore sleeve 284 that is secured to the first wall section 276A of interior wall 276. The trigger element 268 is sized to fit slidably within the first wall section 276A of the interior wall 276 and is movable back and forth within the interior bore 278.

The trigger element 268 includes a trigger activation member 286 that is disposed at the first trigger housing open 280. The trigger activation member 286 is coupled to an internal trigger housing 288. The internal trigger housing 288 has an internal wall 289 that defines an interior space that extends from an end member 290 at one end to an internal opening 291 at an opposite end. The end member 290 has a flange section 292 that extends outwardly from the internal wall 289.

The first biasing mechanism 272 is disposed within the interior bore 278 to bias the trigger mechanism 204 into a first position, such as a non-activated position shown in FIG. 6. More specifically, the first biasing mechanism 272 engages the flange section 292 of the internal trigger housing 288 to provide a force urging the trigger activation member 286 of the trigger element 268 in a direction external to the first trigger housing opening 280.

Activation trigger 270 and the second biasing mechanism 274 are disposed within the internal wall 289 of the internal trigger housing 288. The second biasing mechanism 274 is attached at one end to the activation trigger 270 and is attached at the opposite end to the end member 290. The second biasing mechanism 274 biases the activation trigger 270 in a direction towards the second trigger housing opening 282.

Attached to the outer trigger housing 266 is a second wire fastener element 293 used to secure the second inner wire end 260 in the trigger mechanism 204. The second wire fastener element 293 extends into the interior bore 278 of the outer trigger housing 266 through trigger bore sleeve 284. The second wire fastener element 293 has an opening sized for the second inner wire end 260 and fixes the second inner wire end 260 in a fixed position such that the inner wire 210 remains in a fixed position with respect to the trigger mechanism 204. The second cable housing end 262 is coupled to the trigger activation member 286 of the trigger element 268. The second cable housing end 262 may be secured to the trigger activation member 286 by friction, adhesives or other conventional methods.

As shown in FIG. 6, a section of the cable housing 208 has been removed between vertical line 60 and vertical line 62 to illustrate the mechanical movement of the mechanical control cable 206. In the embodiment shown in FIG. 6, the cable housing 208 moves while the inner wire 210 is stationary and functions as a support and guide to the cable housing 208. The section of the inner wire 210 between vertical line 60 and vertical line 62 remains fixed and this section remains stationary when the trigger mechanism 204 changes positions, as discussed in more detail with respect to FIG. 7.

FIG. 6 further shows a schematic view of the hydraulic valve 400 in a first position. Hydraulic valve 400 is representative of the hydraulic valves 400A, 400B shown and described with respect to FIGS. 1-3. In the embodiment shown in FIG. 6, the hydraulic valve 400 is coupled to the trigger mechanism 204. The hydraulic valve 400 is a two-position valve, as schematically shown. A control line 112 is coupled to the hydraulic valve 400 and includes both a supply line and a return line. The control line 112 leads to the control station 110 shown in FIGS. 1-2.

In the embodiment shown in FIG. 6, the position of the hydraulic valve 400 is in a no-flow position, as shown by no-flow symbol 402, when the trigger mechanism 204 is in the first position or non-activated position. In other embodiments, the hydraulic valve 400 may be in a flow position when the trigger mechanism 204 is in the first position or non-activated position. The hydraulic valve 400 may be a spring-biased valve as shown by spring symbol 404.

Figure 7:
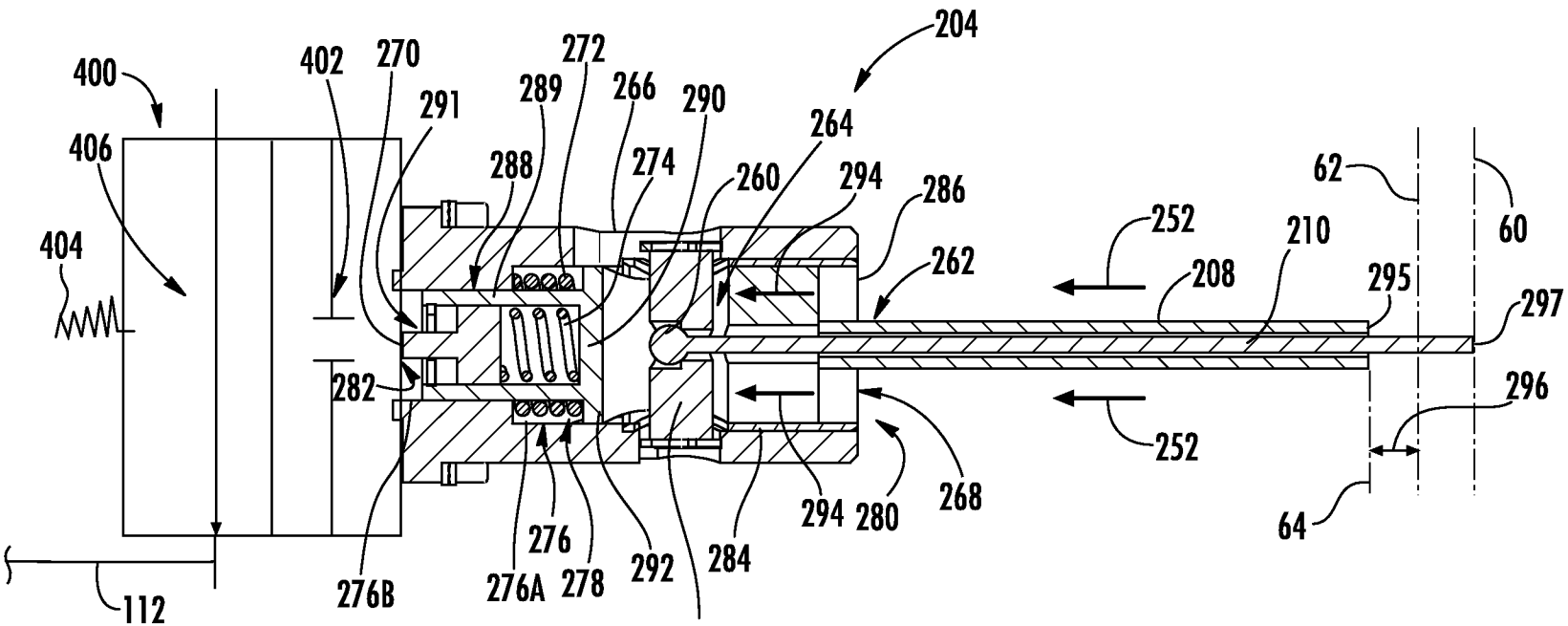
FIG. 7 depicts a schematic cross-sectional view of a control cable, trigger mechanism, and hydraulic valve in a second position according to one embodiment.

FIG. 7 shows a schematic cross-section of embodiments of the mechanical control cable 206 and the trigger mechanism 204 in a second position, such as an activated position according to one embodiment. FIG. 5 and FIG. 7 together illustrate the sensor mechanism 202 and the trigger mechanism 204 of the mechanical signal mechanism 200 in a second position, such as an activated position. The mechanical control cable 206 coupled to the sensor mechanism 202 in FIG. 5 extends and continues to the trigger mechanism 204 shown in FIG. 7 to illustrate the second position, such as the activated position for the mechanical signal mechanism 200. The cable housing 208 of the mechanical control cable 206 moves in the direction shown by cable housing arrows 252 in FIG. 5 and FIG. 7.

The second position in the embodiment shown in FIG. 7 is an activated position for the trigger mechanism 204. The trigger mechanism 204 moves from the first position, shown in FIG. 6, to the second position, shown in FIG. 7, in response to the sensor mechanism 202 moving from a first position to a second position.

Referring to FIGS. 6-7, a section of the cable housing 208 has been removed to illustrate the movement of the cable housing 208. As shown in FIG. 6, a second wire section end 297 is positioned at vertical line 60 and cable housing section end 295 is positioned at vertical line 62 when the trigger mechanism 204 is in the first position. The control cable movement of the cable housing 208 when the trigger mechanism 204 is moved from the first position, shown in FIG. 6, to the second position, shown in FIG. 7, is illustrated by the control cable movement measurement 296 showing the distance the cable housing 208 has traveled between vertical line 62 and vertical line 64. The second wire section end 297 of the inner wire 210 remains at vertical line 60 and the inner wire 210 does not move due to the trigger mechanism 204 changing positions.

More specifically, the cable housing 208 moves from the first trigger housing opening 280 towards the second trigger housing opening 282 of the trigger mechanism 204. The movement of the cable housing 208 pushes the trigger activation member 286 of the trigger element 268 to move the trigger element 268 in the direction of arrows 294. The cable housing 208 pushes the trigger element 268 with sufficient force to overcome the force of the first biasing mechanism 272 against the end member 290 of the internal trigger housing 288. The internal trigger housing 288 moves the activation trigger 270 to engage the hydraulic valve 400 so as to switch the hydraulic valve 400 from a first position to a second position.

The movement of the activation trigger 270 is a mechanical trigger signal that moves the hydraulic valve 400 from a first position to a second position. In the embodiment shown in FIG. 7, the hydraulic valve 400 moves from a no-flow valve position when in a first position to a flow position when in the second position. The second position of the hydraulic valve 400 is shown by flow symbol 406 in FIG. 7. The embodiment of the hydraulic valve 400 shown in FIG. 7 is a spring biased valve as shown by spring symbol 404. In one embodiment, the activation trigger 270 may press against a valve element to overcome a biasing mechanism force to position the hydraulic valve 400 from the first position to the second position.

The trigger mechanism 204 provides valve protection against overloading the hydraulic valve 400 by providing the second biasing mechanism 274 to control the force that the activation trigger 270 applies to the hydraulic valve 400. As the activation trigger 270 moves towards and engages the hydraulic valve 400, the hydraulic valve 400 exerts an opposing force against activation trigger 270 of the trigger element 268. If the opposing force from the hydraulic valve 400 is sufficient to overcome the force of the second biasing mechanism 274, the activation trigger 270 will move away from the hydraulic valve 400 and in a direction opposite the movement of the internal trigger housing 288 and arrows 294. The second biasing mechanism 274 controls the force being applied to the hydraulic valve 400 to within a selected range and below a selected maximum activation force. In some embodiments, the second biasing mechanism 274 may have a selected biasing force greater than the selected maximum activation force of the valve 400. The second biasing member 274 may have a selected biasing force that is selected to correspond to the selected maximum activation force of the valve 400.

When in the second position, the hydraulic valve 400 flows fluid through the hydraulic valve 400 to the control line 112 to control station 110. The control station 110 provides an indication signal that the elevator 106 is in a second position in response to the fluid signal provided by the hydraulic valve 400 when hydraulic valve 400 is positioned into the second position. The indication signal may be a sound signal or visual signal that would alert an operator that the elevator 106 is in the second position or activated position.

In operation, elevator system 102 may start in a first position where the elevator clamps are in a first position or non-activated position, as shown in FIG. 2. A tubular member 16 is then positioned into the central opening 136 of the elevator 106, and the control station 110 signals the elevator 106 to move to the second position or activated position. The elevator 106 moves the elevator doors 126, 128 and the clamp elements 146, 148, 150, 152 into the second position where the elevator doors 126, 128 are closed and the clamp elements 146, 148, 150, 152 are moved to the second position to engage and support the tubular member 16, as shown in FIG. 1 and FIG. 3.

As shown in FIG. 3, the movement of the clamp element 148 to the second position actuates the sensor element 222 of the sensor mechanism 202. The sensor mechanism 202 moves from the first position, shown in FIG. 4, to the second position, shown in FIG. 5 in response to the actuation of the sensor element 222. The actuation of the sensor element 222 results in the cable housing 208 moving, as shown by FIGS. 4-5 and movement arrow 256. The movement of the mechanical control cable 206 is produced in response to movement of the sensor element 222 from the first sensor position to the second sensor position. The movement of cable housing 208 is also shown in FIGS. 6-7 and control cable movement measurement 296 that shows the distance of movement of the mechanical control cable 206 when the sensor mechanism 202 moves from the first position to the second position. The control cable movement shown by control cable movement measurement 296 of FIG. 7 causes the trigger element 268 to move the activation trigger 270 of the trigger mechanism 204.

More specifically, the activation trigger 270 makes a trigger movement in response to the movement of the cable housing 208. The distance that the activation trigger 270 moves corresponds to the distance that the cable housing 208 of the mechanical control cable 206 moves. The movement of the cable housing 208 in response to the sensor mechanism 202 moving from the first position to the second position is the control cable movement. The control cable movement produces and is in unison with the trigger movement. The force applied by the activation trigger 270 to the hydraulic valve 400 is limited by the second biasing mechanism 274.

The hydraulic valve 400 moves from the first position to the second position in response to the trigger movement of the trigger mechanism 204. The hydraulic valve 400 transmits a hydraulic signal to the control station 110 using control line 112 when placed into the second position by the trigger mechanism 204. The hydraulic signal may be transmitted when the hydraulic valve 400 opens a flow valve when positioned in the second position.

The control station 110 generates an alert signal in response to the hydraulic signal sent by the hydraulic valve 400 when in the second position. More specifically, the alert signal is generated by transmitting a mechanical signal by a mechanical control cable 206 coupled to the hydraulic valve 400 to move the hydraulic valve 400 into a valve position to send the hydraulic signal that the elevator 106 is in the second elevator position. An operator is alerted by the alert signal from the control station 110 generated in response to the hydraulic signal. Generating the alert signal that the elevator 106 is in the second elevator position in response to the hydraulic signal may trigger the operator to take selected actions in response to the alert signal, including directing the movement of the tubular member 16 by the elevator 106.

While the foregoing is directed to embodiments of the disclosure, other and further embodiments of the disclosure may be devised without departing from the basic scope thereof, and the scope thereof is determined by the claims that follow.

The invention claimed is:

1. An elevator system for supporting a tubular member, comprising:

an elevator movable between a first elevator position and a second elevator position;

a clamp element;

a first mechanical signal mechanism coupled to the elevator, the first mechanical signal mechanism having a first sensor located in an upper bore of a carrying structure, the first sensor located between the clamp element and the carrying structure;

a second mechanical signal mechanism coupled to the elevator, the second mechanical signal mechanism having a second sensor located in a lower bore of the carrying structure, the second sensor located between the clamp element and the carrying structure; and a valve coupled to the first or second mechanical signal mechanism, wherein the first or second mechanical signal mechanism is configured to transmit a mechanical signal by a mechanical control cable to move the valve into a valve position to send a valve signal that the elevator is in the second elevator position.

2. The elevator system of claim 1, wherein the elevator provides support to the tubular member for moving the tubular member when the elevator is in the second elevator position, and wherein the valve is a hydraulic valve, a pneumatic valve, or an electric valve.

3. The elevator system of claim 2, wherein the elevator has a central opening and the clamp element disposed adjacent the central opening, wherein the first elevator position is a first clamp position and the second elevator position is a second clamp position.

4. The elevator system of claim 1, wherein the elevator has an elevator body with an elevator body outer surface and an elevator door coupled to the elevator body, and wherein the valve is located at the elevator body outer surface of the elevator body.

5. The elevator system of claim 1, wherein the elevator system further comprises a control station disposed remotely from the elevator, and wherein the valve is disposed at the control station.

6. The elevator system of claim 1, wherein an alert signal that the elevator is in the second elevator position is generated in response to the valve signal.

7. An elevator system for supporting a tubular member, comprising:

an elevator movable between a first elevator position and a second elevator position;

a clamp element;

a first mechanical signal mechanism coupled to the elevator, the first mechanical signal mechanism having a first sensor located in an upper bore of a carrying structure, the first sensor located between the clamp element and the carrying structure;

a second mechanical signal mechanism coupled to the elevator, the second mechanical signal mechanism having a second sensor located in a lower bore of the carrying structure, the second sensor between the clamp element and the carrying structure;

the first sensor or the second sensor being configured to make a sensor mechanism movement in response to the elevator moving from the first elevator position to the second elevator position;

a mechanical control cable having a first cable end and a second cable end, wherein the first cable end is coupled to the first sensor or the second sensor;

a trigger mechanism coupled to the second cable end of the mechanical control cable, wherein the mechanical control cable transmits the sensor mechanism movement of the first sensor or the second sensor to the trigger mechanism so that the trigger mechanism has a trigger movement; and a valve coupled to the trigger mechanism such that the trigger movement of the trigger mechanism is transmitted to the valve to move the valve into a position to send a valve signal that the elevator is in the second elevator position.

8. The elevator system of claim 7, wherein the mechanical control cable has an inner wire and a cable housing, wherein the inner wire extends through the cable housing and the cable housing is movable with respect to the inner wire so as to provide the trigger movement of the trigger mechanism, and wherein the valve is a hydraulic valve, a pneumatic valve, or an electric valve.

9. The elevator system of claim 8, wherein the inner wire has a first inner wire end coupled to the first sensor or the second sensor and a second inner wire end coupled to the trigger mechanism, and wherein the elevator system is configured to move the cable housing over the inner wire such that the mechanical control cable transmits the sensor mechanism movement of the first sensor or the second sensor through the cable housing to the trigger mechanism.

10. The elevator system of claim 7, wherein the first sensor or the second sensor has a sensor housing and a sensor element, wherein the sensor element has a first position and a second position and the sensor element is mechanically activated by the elevator to move from the first position to the second position in response to the elevator moving from the first elevator position to the second elevator position, and wherein the first cable end of the mechanical control cable is disposed in the sensor housing and is coupled to the sensor element so as to produce a control cable movement in response to the sensor element moving from the first position to the second position.

11. The elevator system of claim 10, wherein the first sensor or the second sensor has a sensor biasing mechanism for biasing the sensor element in the first position.

12. The elevator system of claim 10, wherein the control cable movement produces and is in unison with the trigger movement.

13. The elevator system of claim 10, wherein the trigger mechanism has an outer trigger housing and a trigger element, wherein the second cable end of the mechanical control cable is disposed in the outer trigger housing and is mechanically coupled to the trigger element, and wherein the trigger movement provides a mechanical trigger signal that the elevator is in the second elevator position.

14. The elevator system of claim 7, wherein the trigger mechanism has a first biasing mechanism for biasing the trigger mechanism in a non-activated position.

15. The elevator system of claim 14, wherein the trigger mechanism has an inner trigger housing, an outer trigger housing, and a second biasing mechanism and an activation trigger disposed in the inner trigger housing, wherein the second biasing mechanism biases the activation trigger to control a force applied by the activation trigger to the valve.

16. A method of signaling a position of an elevator for supporting a tubular member, comprising:

supporting the tubular member with the elevator;

moving the elevator from a first elevator position to a second elevator position, wherein the elevator has a central opening and a clamp element disposed adjacent the central opening, wherein the clamp element is in a non-activated position when the elevator is in the first elevator position and the clamp element is in an activated position when the elevator is in the second elevator position;

activating one or more of a first sensor or a second sensor, wherein the first sensor is located in an upper bore of a carrying structure and between the clamp element and the carrying structure, and the second sensor is located in a lower bore of the carrying structure and between the clamp element and the carrying structure; and transmitting a mechanical signal by a mechanical control cable coupled to a valve to move the valve into a valve position to send a valve signal that the elevator is in the second elevator position, wherein the valve is a hydraulic valve, a pneumatic valve, or an electric valve.

17. The method of claim 16, further comprising:

generating an alert signal that the elevator is in the second elevator position in response to the valve signal.

18. The method of claim 17, wherein the alert signal is generated at a control station disposed remotely from the elevator, and wherein the valve is disposed at the control station.

19. The method of claim 16, wherein the transmitting the mechanical signal by the mechanical control cable comprises moving one or more of an inner wire or a cable housing of the mechanical control cable.

* * * * *